US005311713A

United States Patent [19]

Goodrich

[11] Patent Number: 5,311,713

[45] Date of Patent: May 17, 1994

[54] ELECTRIC AND TELEPHONE POLE GROUND PROTECTOR

[76] Inventor: Bill J. Goodrich, 4728 SE. Roethe Rd., Milwaukie, Oreg. 97267

[21] Appl. No.: 949,270

[22] Filed: Sep. 21, 1992

Related U.S. Application Data

[63] Continuation-in-part of Ser. No. 785,778, Nov. 29, 1991, abandoned.

[51] Int. Cl.[5] ..... E04H 12/00

[52] U.S. Cl. ..... 52/301; 52/728; 52/DIG. 13

[58] Field of Search ..... 52/301, DIG. 13, 728; 220/4.22, 4.23, 4.24; 215/724

[56] References Cited

U.S. PATENT DOCUMENTS

| | | | |
|---|---|---|---|
| 368,222 | 8/1887 | McEwen | 52/301 |
| 687,093 | 11/1901 | Wheeler | 52/728 |
| 1,838,702 | 12/1931 | Partridge | 220/4.22 |
| 3,319,328 | 5/1967 | Finger et al. | 52/301 |
| 4,161,090 | 7/1979 | Watts, Jr. | 52/301 |
| 4,216,634 | 8/1980 | Binder | 52/301 |
| 4,231,189 | 11/1980 | Hochberg | 220/4.24 |
| 4,245,931 | 1/1981 | Watts, Jr. | 52/301 |
| 4,457,445 | 7/1984 | Hanks et al. | 220/724 |
| 4,796,649 | 1/1989 | Tolomay | 52/DIG. 13 |
| 4,799,340 | 1/1989 | Lichau et al. | 52/728 |

FOREIGN PATENT DOCUMENTS

| | | | |
|---|---|---|---|
| 204243 | 7/1959 | Austria | 52/297 |
| 7401058 | 5/1975 | Netherlands | 52/728 |

*Primary Examiner*—Carl D. Friedman
*Assistant Examiner*—Christopher T. Kent
*Attorney, Agent, or Firm*—William A. Birdwell

[57] ABSTRACT

A device and method for protecting the end of a wooden utility pole set in the ground. A split cylindrical casing is provided which can be placed around the lower end of a wooden utility pole just before it is installed in the ground. The casing comprises an elongate, relatively thin cylindrical member having one closed end and being split into two sections connected together along the side thereof. The connection acts as a hinge. The edges of the casing where it is split are provided with a fastener, one part of the fastener being disposed along the edge of one part of the casing and another part of the fastener being disposed along the edge of the other part of the casing. When the cylindrical casing is closed, the edge of one part overlaps the edge of the other part so that the respective parts of the fasteners fit matingly together. Preferably, the fastener extends the entire length of the casing and entirely across the bottom end thereof. Preferably, the casing is made of high grade plastic.

15 Claims, 1 Drawing Sheet

ELECTRIC AND TELEPHONE POLE GROUND PROTECTOR

This is a divisional continuation-in-part of copending application(s) Ser. No. 07/785,778 filed on Nov. 29, 1991 now abandoned.

BACKGROUND OF THE INVENTION

This invention relates to devices and methods for protecting wooden utility poles of the type used to support aerial electric and telephone lines from deterioration, and particularly to casings for placement over the end of a wooden utility pole when it is set in the ground so as to prevent the pole from deteriorating due to absorption of moisture and living organisms.

As is well known, wooden utility poles with one end set in the ground are commonly used to support aerial electric and telephone lines. Such poles are subject to deterioration due to the absorption of moisture and the activity of living organisms such as bacteria, fungi, insects and borers. To maximize the life of the wooden poles, the poles usually are treated with creosote or some other material which combats deterioration of the poles. While such materials greatly increase the useful life of wooden utility poles, they do not entirely prevent deterioration. Consequently, there is a need for devices and methods to increase further the life of a wooden pole set in the ground to support aerial electric and telephone wires.

Some devices for protecting the top of wooden poles are known. For example, Finger et al. U.S. Pat. No. 3,319,328 discloses a cylindrical cap to be placed on the upper end of a wooden utility pole to protect that end from moisture, bacteria fungi, insects and borers. Watts, Jr. U.S. Pat. No. 4,245,931 and Watts, Jr. U.S. Pat. No. 4,161,090 also disclose caps for protecting the upper end of a wooden pole. However, none is well adapted for rapid and convenient placement over the lower end of a utility pole when that pole is about to be placed in the ground so as to entirely separate the lower end of the post from the ground and seal it off from moisture, bacteria, fungi, insects and borers.

McEwen U.S. Pat. No. 368,222 discloses a wooden post having an earthen ware casing to protect the post in the ground. However, the casing is bulky, difficult to install and does not entirely protect the lower end of the post.

Therefore, there is a need for an improved device and method for protecting the lower end of a wood utility pole set in the ground.

SUMMARY OF THE INVENTION

The present invention overcomes the limitations of prior wooden pole protection devices and methods by providing a split cylindrical casing which can be placed rapidly around the lower end of a wooden utility pole just before it is installed in the ground. The casing comprises an elongate, relatively thin cylindrical member having one closed end and being split into two sections connected together along the side thereof. The connection acts as a hinge. The edges of the casing where it is split are provided with a fastener, one part of the fastener being disposed along the edge of one part of the casing and another part of the fastener being disposed along the edge of the other part of the casing. When the cylindrical casing is closed, the edge of one part overlaps the edge of the other part so that the respective parts of the fasteners fit matingly together. Preferably, the fastener extends the entire length of the casing and entirely across the bottom end thereof. Preferably, the casing is made of high grade plastic.

Accordingly, it is a principle object of the present invention to provide a new and improved device and method for protecting the end of a wooden utility pole set in the ground.

It is another object of the present invention to provide such a device and method whereby the device may be installed conveniently and rapidly just prior to placement of the end of the wooden utility pole in the ground.

It is a further object of the present invention to provide such a device and method which separates the bottom of a wooden utility pole from the ground at its lower end as well as along the side of the pole.

The foregoing and other objects, features and advantages of the invention will be more readily understood upon consideration of the following detailed description of the invention, taken in conjunction with the accompanying drawings.

DESCRIPTION OF THE PREFERRED EMBODIMENT

Figure 1:
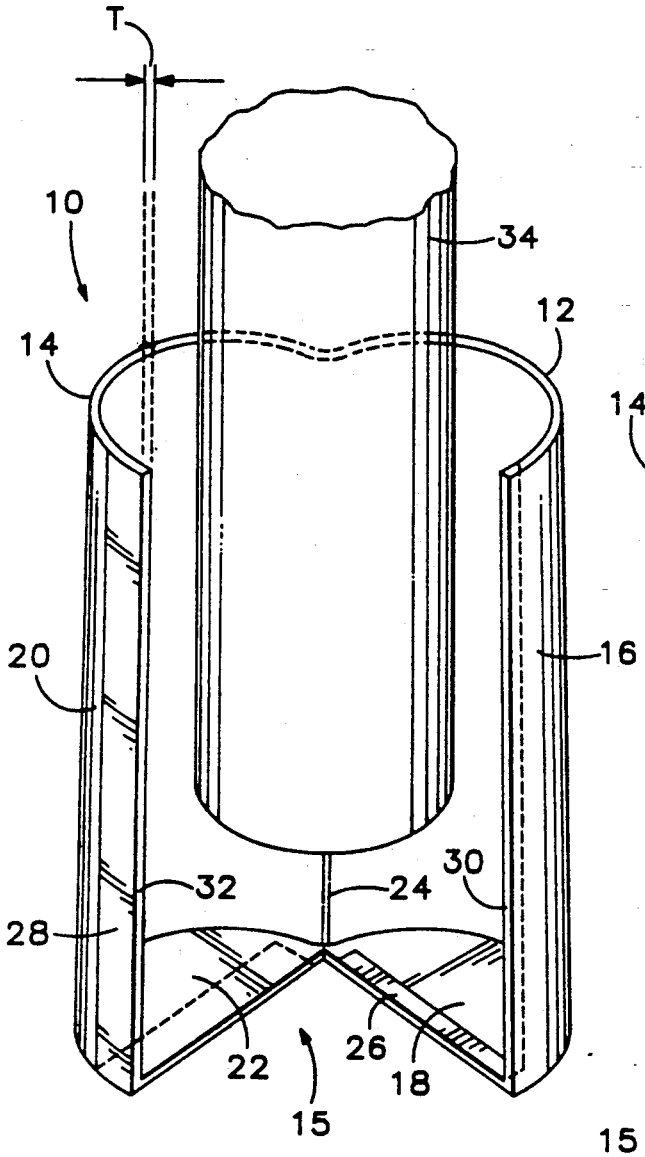
FIG. 1 shows a device for protecting the lower end of a wooden utility pole according to the present invention in an uninstalled, open condition.

Referring to FIG. 1, the utility pole protection device of the present invention comprises an elongate, cylindrical member, or casing, 10 having a closed end 15 and being split into a first section 12 and a second section 14. The first section 12 has a side wall 16 and an end wall 18. Similarly, the second section 14 has a side wall 20 and end wall 22. Preferably, the cylindrical member 10 is made of high grade, flexible plastic, though any suitable plastic may be used. Also, preferably the cylindrical member is somewhat tapered so as to be narrower at the top than at the bottom.

The first section 12 and the second section 14 are connected together along the side of the cylindrical member 10 so as to form a hinge 24 which extends the entire length of the cylindrical member. First and second mating parts, 26 and 28, of a fastener are disposed at the edges 30 and 32 of the first section 12 and the second section 14, respectively. Preferably, the fastener is a hook-and-loop type fastener, such as that marketed under the trademark VELCRO. One part 26, for example a hook portion, is attached on the interior surface of the cylindrical member adjacent edge 30 of first section 12, and the other part 28, a loop portion in the case of a hook-and-loop fastener, is attached to the exterior surface of the cylindrical member adjacent edge 32 of the second section 14. The disposition of the mating parts of the fastener could be reversed, and other types of mating fasteners could be used, without departing from the principles of the invention.

Figure 2:
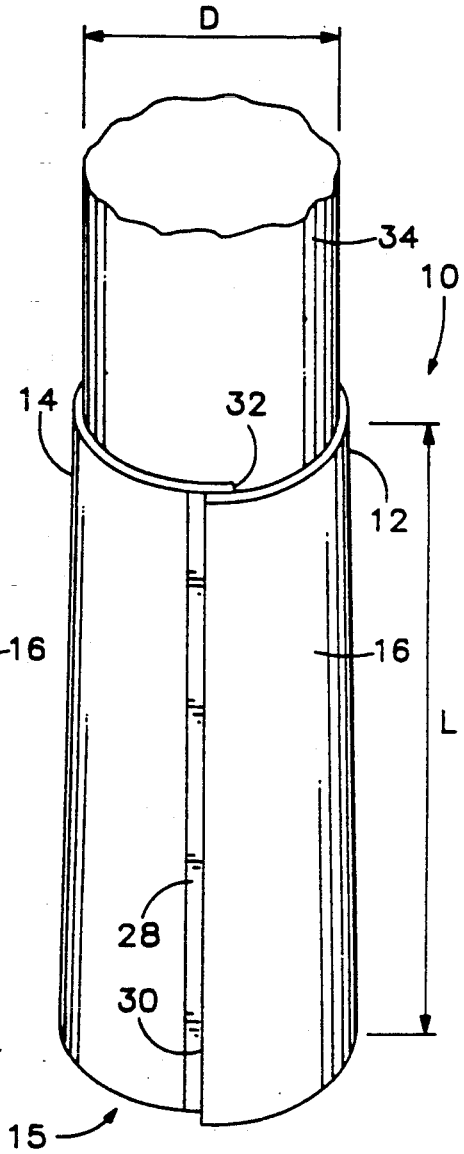
FIG. 2 shows a device for protecting the lower end of a wooden utility pole according to the present invention in a closed configuration installed on the lower end of a wooden utility pole.

As shown in FIG. 2, the cylindrical member 10 may be closed around the bottom end of wooden pole 34, thereby encasing the end of the pole. Edge 30 of the cylindrical member overlaps the edge 32, where the mating parts of the fastener attach to one another.

Those edges also overlap at the closed end 15 to seal off the end when the cylindrical member is in its closed position.

Preferably, the length L of the cylindrical member 10 is within the range from 2 feet to 12 feet long. Preferably, the cylindrical member has an inside diameter D within the range from 6 inches to 48 inches. The thickness T of the side and end walls of the cylindrical member is preferably in the range from 1/16 inch to ⅛ inch.

To protect a wooden utility pole 34, the cylindrical member 10 is placed around the lower end of the pole before the pole is set in the ground. Then, the two sections 12 and 14 of the cylindrical pole are closed toward one another. The edges 30 and 32 will overlap along the side and at the closed end to a degree dependent on the diameter of the pole. This enables the mating parts 26 and 28 of the fastener to attach to one another, thereby holding the cylindrical member 10 snugly around the pole 34 and substantially sealing it off from moisture and living organisms. In addition, silicone or other similar sealing material may be placed along the overlapping edges of the cylindrical member, and forced into any spaces between the parts 26 and 28 of the fastener, to further seal the casing. The lower end of the pole, covered by the casing, is then set in the ground.

While the device and method of the invention have been described with respect to protecting a utility pole, it is to be understood that the device and method could be used to protect any wooden pole set in the ground without departing from the principles of the invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A device for protecting the end of a wooden utility pole set in the ground, comprising:

(a) an integrally formed, substantially cylindrical member having an elongate dimension, said member having a closed end, and being partially split into first and second sections along said elongate dimension thereof so as to form a first edge along the side and across said closed end of said first section and a second edge along the side and across said closed end of said second section, a hinge being formed along the side of said member where said first section is joined to said second section, said member further having an interior surface and an exterior surface and being formed of a substantially flexible material; and (b) fastener means, disposed on said first section and said second section of said cylindrical member adjacent said first edge and said second section respectively such that said first edge is adapted to be placed over said second edge thereby substantially sealing said first and second sections together.

2. The device of claim 1, wherein said fastener means is disposed substantially along the entire length of said first side and said second side and across said closed end of said cylindrical member.

3. The device of claim 1, wherein said cylindrical member comprises plastic.

4. The device of claim 1, wherein said cylindrical member is tapered inwardly from said closed end to said open end.

5. The device of claim 1, wherein said fastener means includes first and second mating parts, said first mating part being disposed on the interior surface of said first section of said cylindrical member adjacent said first edge and said second mating part being disposed on the exterior surface of said cylindrical member adjacent said second edge so as to matingly engage one another.

6. The device of claim 5, wherein said fastener means comprises a hook and loop type fastener.

7. The device of claim 1, wherein said fastener means comprises silicone.

8. A method for protecting the end of a wooden utility pole when set in the ground, comprising the steps of:

(a) placing around said end of the pole a substantially cylindrical member having an elongate dimension, said member having a closed end and an open end and being partially split into first and second sections along said elongate dimension thereof so as to form a first edge along the side and across said closed end of said first section and a second edge along the side and across said closed end of said second section, a hinge being formed along the side of said member where said first section is joined to said second section;

(b) closing said two sections of said cylindrical member over said end of said pole so that said first edge overlaps said second edge; and (c) fastening said edges of said two sections together before placing said end of said pole in the ground.

9. The method of claim 8, wherein said cylindrical member has an interior surface and an exterior surface and is formed of a substantially flexible material, said method further comprising fastening said first edge and said second edge together using fastener means comprising a first mating part being disposed on the interior surface of said first section of said cylindrical member adjacent said first edge and a said second mating part being disposed on the exterior surface of said second section of said cylindrical member adjacent said second edge.

10. The method of claim 9, wherein the step of fastening said edges of said two sections together using fastening means includes providing said fastener means substantially along the entire length of said side and across said closed end of said cylindrical member.

11. The method of claim 9, wherein the step of fastening said edges of said two sections together using fastening means includes providing a hook and loop type fastener.

12. The method of claim 8, wherein the step of placing a substantially cylindrical member around said end of the pole includes providing a cylindrical member comprising plastic.

13. The method of claim 8, wherein said cylindrical member is tapered inwardly from said closed end to said open end.

14. The method of claim 8, further comprising placing silicone along the joint where said two sections are fastened together.

15. The method of claim 8, wherein said fastening step is accomplished by placing silicone along the joint where said two sections are fastened together.

* * * * *